US011403898B2

(12) United States Patent
Lee

(10) Patent No.: US 11,403,898 B2
(45) Date of Patent: Aug. 2, 2022

(54) MULTI-LOCKING DEVICE USING RANDOM PASSWORD

(71) Applicant: Ki Chul Lee, Gimpo-si (KR)

(72) Inventor: Ki Chul Lee, Gimpo-si (KR)

( * ) Notice: Subject to any disclaimer, the term of this patent is extended or adjusted under 35 U.S.C. 154(b) by 0 days.

(21) Appl. No.: 17/604,792

(22) PCT Filed: Oct. 5, 2020

(86) PCT No.: PCT/KR2020/013446
§ 371 (c)(1),
(2) Date: Oct. 19, 2021

(87) PCT Pub. No.: WO2021/071177
PCT Pub. Date: Apr. 15, 2021

(65) Prior Publication Data

US 2022/0148353 A1 May 12, 2022

(30) Foreign Application Priority Data

Oct. 7, 2019 (KR) ..... 10-2019-0124034

(51) Int. Cl.
*G07C 9/00* (2020.01)

(52) U.S. Cl.
CPC ... *G07C 9/00309* (2013.01); *G07C 2009/005* (2013.01); *G07C 2009/00253* (2013.01); *G07C 2009/00523* (2013.01)

(58) Field of Classification Search
CPC ..... G07C 9/00309; G07C 2009/00253; G07C 2009/005; G07C 2009/00523; G07C 9/00571; G07C 9/21
USPC ..... 340/5.61
See application file for complete search history.

(56) References Cited

U.S. PATENT DOCUMENTS 5,438,312 A * 8/1995 Lewis ..... B60Q 9/00 340/542
2012/0068818 A1* 3/2012 Mizon ..... H04W 12/08 340/5.61
2012/0268243 A1* 10/2012 Kappeler ..... G07C 9/22 340/5.61

(Continued)

FOREIGN PATENT DOCUMENTS

JP 2009-215797 A 9/2009
JP 2017-182604 A 10/2017

(Continued)

OTHER PUBLICATIONS

Korea Intellectual Property Office Notification of Reason for Refusal for KR 10-2019-0124034 dated Jun. 12, 2021.

(Continued)

*Primary Examiner* — Edwin C Holloway, III
(74) *Attorney, Agent, or Firm* — Sughrue Mion, PLLC

(57) ABSTRACT

Provided is a multi-locking device including a locking device management unit configured such that, when a user requests same to grant a right to open/close a door, same converts information regarding a granted right regarding the door into a QR code, outputs same, and provides same to the user, a door locking device configured to receive the information regarding a granted right regarding the door from the locking device management unit, and a QR code reader unit configured to receive the QR code from the user and provide same to the door locking device.

5 Claims, 6 Drawing Sheets

(56) References Cited

U.S. PATENT DOCUMENTS

| | | | | |
|---|---|---|---|---|
| 2013/0214902 | A1* | 8/2013 | Pineau | G05B 1/00 340/5.61 |
| 2015/0129657 | A1* | 5/2015 | Rogers | G07C 9/00182 235/382 |
| 2015/0341336 | A1* | 11/2015 | Trell | H04L 67/10 726/5 |
| 2016/0328903 | A1 | 11/2016 | Roberts | |

FOREIGN PATENT DOCUMENTS

| | | | |
|---|---|---|---|
| JP | 2017-199132 | A | 11/2017 |
| KR | 10-2018-0048095 | A | 5/2018 |

OTHER PUBLICATIONS

Korea Intellectual Property Office Grant of Patent for KR 10-2019-0124034 dated Jul. 19, 2021.
International Search Report for PCT/KR2020/013446 dated Apr. 8, 2021 [PCT/ISA/210].

* cited by examiner

FIG. 4A

☐ LOCKING MANAGEMENT SYSTEM SCREEN
(RANDOM PASSWORD IS STORED ONLY FOR EACH USER AND IS NOT DISPLAYED)

| NUMBER | DOOR ID | USER HAVING RIGHT TO OPEN (CLOSE) DOOR | PASSWORD |
|---|---|---|---|
| 1 | XXXXXX | XXXX | **** |
| | | XXXX | **** |
| | | XXXX | **** |
| 2 | XXXXXX | XXXX | **** |
| 3 | XXXXXX | XXXX | **** |
| | | XXXX | **** |
| | | XXXX | **** |

FIG. 4B

☐ EXAMPLE OF COMMUNICATION DATA PACKAGE

| DOOR ID | USER ID | RANDOM PASSWORD | GRANTED RIGHT TO OPEN OR CLOSE DOOR |
|---|---|---|---|
| 00bit | 00bit | 00bit | 0bit |

MULTI-LOCKING DEVICE USING RANDOM PASSWORD

CROSS REFERENCE TO RELATED APPLICATIONS

This application is a National Stage of International Application No. PCT/KR2020/013446 filed Oct. 5, 2020, claiming priority based on Korean Patent Application No. 10-2019-0124034 filed Oct. 7, 2019, the entire disclosures of which are incorporated herein by reference.

TECHNICAL FIELD

Embodiments of the present invention relate to a multi-locking device using a random password.

BACKGROUND ART

Historically, keys have provided incomplete but inexpensive methods of access control to physical property such as buildings, vehicles, containers, safes, and the like. A physical key uses a unique authentication mechanism to operate a specially paired lock or a small number of specially paired locks. Current methods of generating key authentication structures are governed by efficiency requirements that focus on manufacturing, managing, and storing individual key solutions. However, the proliferation of locking devices requiring access control increases concerns about unintentional key duplication. In addition, recently, the advent of fob keys has alleviated these concerns. The fob keys include a small secure hardware device that uses an embedded digital signature.

Meanwhile, there is a field in which, when a plurality of users share and use a plurality of doors and open or close the doors, it is necessary for the users to obtain use rights from a manager and allow only one use (one open or close) (and it is necessary for the user to receive another key (rights) from the manager in order to open or close the door again).

However, in a situation in which opening and closing of the door should be controlled, it is difficult to provide a password or key of the locking device to all users, and many users share many doors, and thus there is a difficulty in key management and the like.

The above-described information disclosed in the background art of the present invention is only for improving the understanding of the background of the present invention, and thus may include information that does not constitute the related art.

DISCLOSURE

Technical Problem

The present invention is directed to providing a multi-locking device using a random password which is capable of reducing the inconvenience caused when a plurality of users, who intend to open or close the same door, need to receive locks/keys from a manager and then return the locks/keys after use.

The present invention is also directed to providing a multi-locking device using a random password which is capable of efficiently controlling and managing the sharing and use of a plurality of doors by a plurality of users.

Technical Solution

One aspect of the present invention provides a multi-locking device using a random password. When a user requests granting of the right to open/close a door, the multi-locking device provides a Quick Response (QR) code including information of a door identification (ID), a user ID, and a random password to the user. The information of the QR code is generated and stored in a locking device management unit and is usable only one time (or a specified number of times) for opening or closing the door. The user with the QR code may obtain the right to open/close the door at any time through a QR code reader. When information of an input QR code matches the information stored in the locking device management unit, the locking device management unit transmits information on the granted right to open/close the door to a door locking device. When the user presses an opening/closing button of the door locking device to which the granted right to open/close the door is transmitted, an opening/closing driving unit is operated to open/close the door. Basically, different users may obtain the right to open/close the same door in the same way and open or close the door. Further, the user may close (or open) the open (or closed) door by re-entering the QR code he or she has.

However, in a door that is closed at normal times, when the door has been opened by even one user, other users cannot close the door. In a door that is opened at normal times, when the door has been closed by even one user, other users cannot open the door.

To help with understanding of the present invention, assuming that, in the door that is closed at normal times, there are N virtual locking devices in series and assuming that, in the door that is opened at normal times, there are N virtual locking devices in parallel, each user unlocks or locks his or her virtual locking device by entering the QR code. In the door that is closed at normal times, the door is closed only when all the N virtual serial locking devices that have been unlocked by N users are locked. In the door that is opened at normal times, the door is opened only when all the N virtual serial locking devices that have been closed by the N users are unlocked.

The locking device management unit may further include a QR code outputting device. According to the purpose of use, the door locking device may receive and store the information on the granted right to open/close the door from the locking device management unit, and in this case, the door locking device may compare the received information with the information provided through the QR code reader, and when the received information matches the information provided through the QR code reader, the door locking device itself may grant the right to open/close the door.

N concurrent users (here, N is a natural number) may use the door and the door locking device may include N opening/closing buttons and one opening/closing driving unit.

The door locking device may include an AND gate configured to receive signals from the locking device management unit and the opening/closing button; a NOT gate configured to receive a signal from the locking device management unit; and an SR flip-flop having a terminal S, through which an output signal of the AND gate is input, and a terminal R through which an output signal of the NOT gate is input, wherein an output signal may be input to the opening/closing driving unit and an opening/closing indicating lamp through a terminal Q of the SR flip-flop.

The door locking device may include a first AND gate configured to receive signals from the locking device management unit and a first opening/closing button; a first NOT gate configured to receive a signal from the locking device management unit; a first SR flip-flop having a terminal S, through which an output signal of the first AND gate is input, and a terminal R through which an output signal of the first NOT gate is input; a second AND gate configured to receive signals from the locking device management unit and a second opening/closing button; a second NOT gate configured to receive a signal from the locking device management unit; a second SR flip-flop having a terminal S, through which an output signal of the second AND gate is input, and a terminal R through which an output signal of the second NOT gate is input; an OR gate configured to receive a first output signal through a terminal Q of the first SR flip-flop and receive a second output signal through a terminal Q of the second SR flip-flop; a first opening/closing indicating lamp configured to receive an output signal through the terminal Q of the first SR flip-flop; and a second opening/closing indicating lamp configured to receive an output signal through the terminal Q of the second SR flip-flop.

Advantageous Effects

According to the embodiments of the present invention, a multi-locking device using a random password can be provided so as to reduce the inconvenience caused when a plurality of users, who intend to open or close the same door, need to receive locks/keys from a manager and then return the locks/keys after use.

Further, according to the embodiments of the present invention, a multi-locking device using a random password, which is capable of efficiently controlling and managing the sharing and use of a plurality of doors by a plurality of users, can be provided.

DESCRIPTION OF DRAWINGS

FIGS. 4A and 4B are exemplary diagrams illustrating a locking management system screen/communication package and a communication data package in a multi-locking device using a random password according to an embodiment of the present invention.

BEST MODE OF THE INVENTION

Hereinafter, the best embodiment of the present invention will be described in detail with reference to the accompanying drawings.

There is a field in which, when a plurality of users share and use a plurality of doors and open or close the doors, it is necessary for the users to obtain use rights from a manager and allow only one use (one open or close) (and it is necessary for the user to receive another key (right) from the manager in order to open or close the door again). The states of the doors may be divided into two types of states as follows.

O Type A (closed state at normal times)

O Type B (open state at normal times)

(Example) The type B corresponds to a case in which there are multiple secure filing cabinets (N locking devices for each filing cabinet) that are shared and used by a plurality of users to store common security documents. N users receive N keys of secure filing cabinets from a manager, put common secure documents in the filing cabinets, and lock the filing cabinets. In order to take out the stored documents, all N locking devices should be unlocked (consent of all the users who set the lock is required). When all the N keys are returned, the corresponding filing cabinets are considered to be finally opened.

Here, an embodiment in which a type B locking device has N opening/closing buttons and N opening/closing indicating lamps will be described. The number of concurrent users per door is limited to N and whether the locking device is locked or unlocked for each user may be displayed on the opening/closing indicating lamps.

Logic, a controller, and other related devices or components of the locking device according to the present invention may be implemented using any suitable hardware, firmware (e.g., application-specific semiconductor), and software or using a suitable combination of software, firmware, and hardware.

Figure 1:
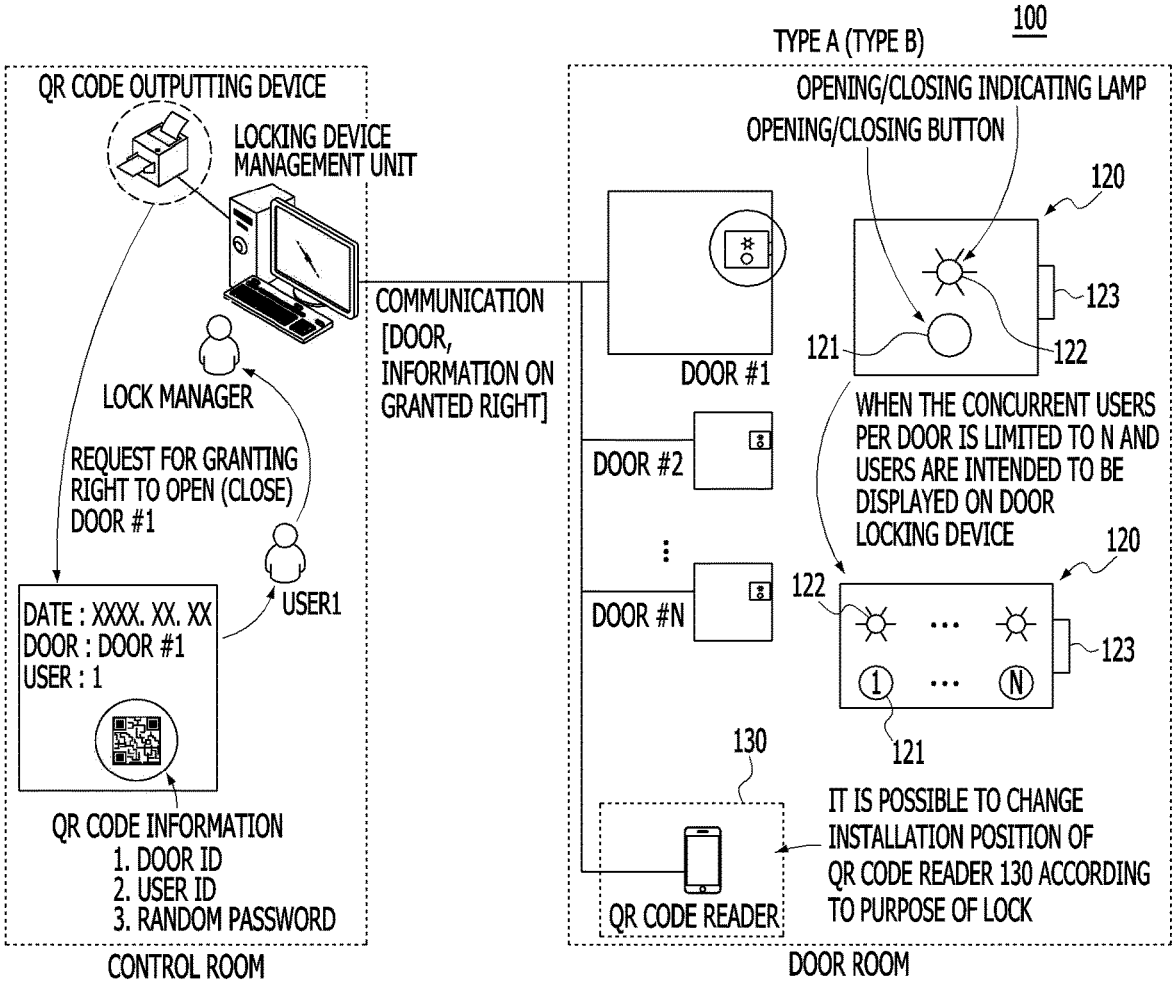
FIG. 1 is a conceptual diagram illustrating a configuration of a multi-locking device using a random password according to an embodiment of the present invention.
Figure 2A:
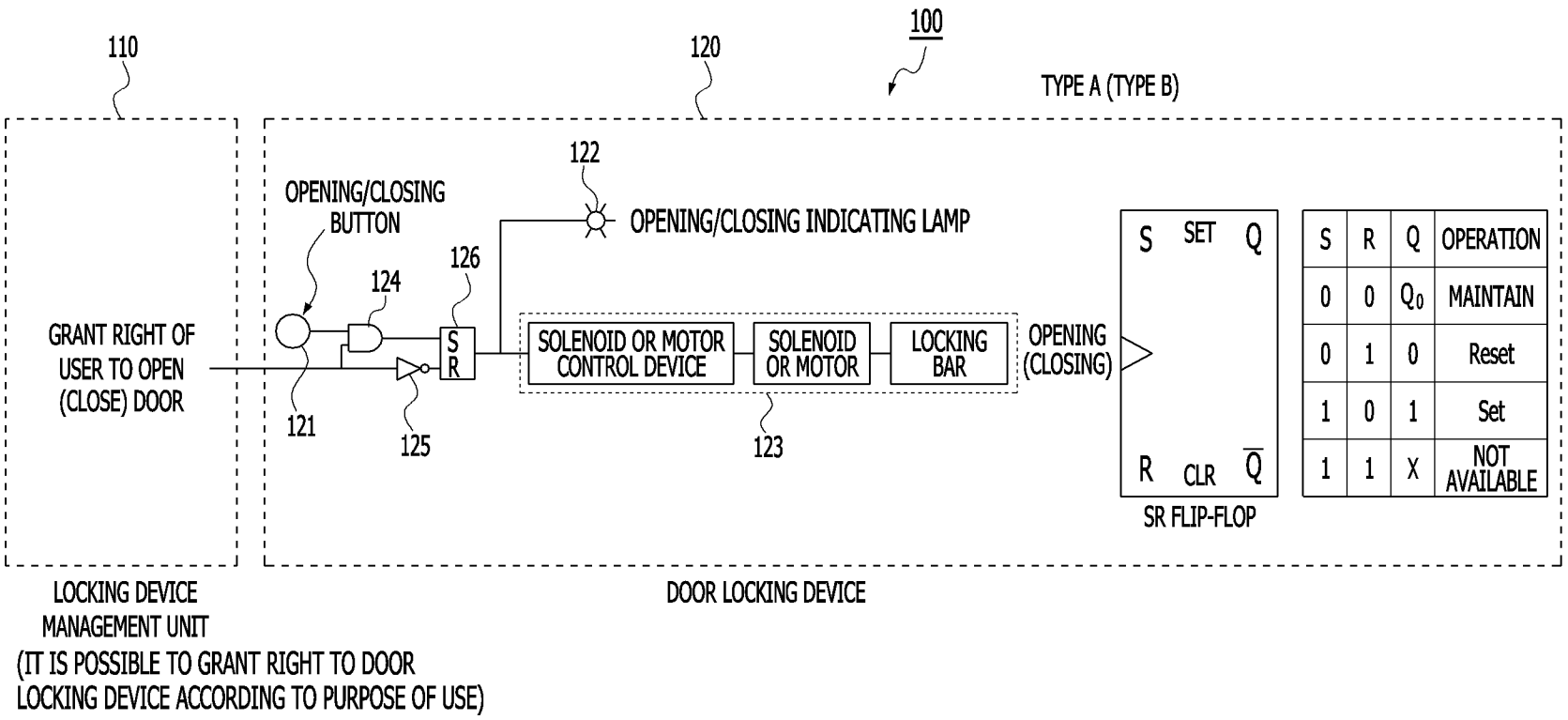
FIGS. 2A and 2B are logic diagrams illustrating configurations of multi-locking devices using random passwords according to embodiments of the present invention.
Figure 2B:
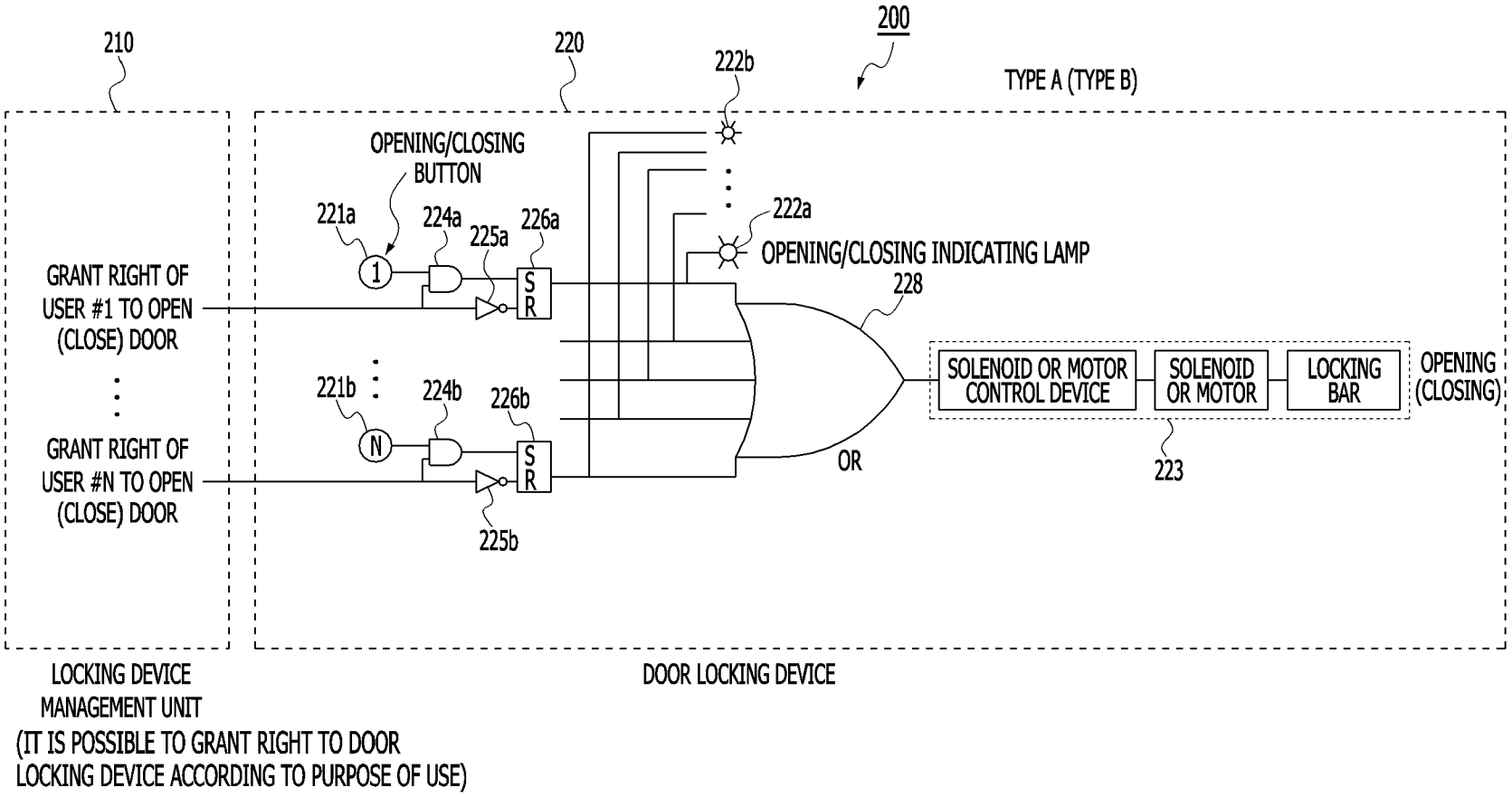

FIG. 1 is a conceptual diagram illustrating a configuration of a multi-locking device 100 using a random password according to an embodiment of the present invention. FIGS. 2A and 2B are logic diagrams illustrating configurations of multi-locking devices 100 and 200 using a random password according to embodiments of the present invention.

As illustrated in FIG. 1, the multi-locking device 100 using a random password according to the embodiment of the present invention may include a locking device management unit 110, a door locking device 120, and a Quick Response (QR) code reader 130. The multi-locking device 100 using a random password according to the embodiment of the present invention may further include a QR code outputting device 111. In the multi-locking device 100, the locking device management unit 110, and the door locking device 120 which are illustrated in FIG. 1, the number of users per door is limited to N. In order to describe a case in which there are N opening/closing buttons and N opening/closing indicating lamps, a multi-locking device 200, a locking device management unit 210, and a door locking device 220 which are illustrated in FIG. 2B will be described.

As illustrated in FIG. 2B, the door locking device 220 may include a first AND gate 224*a* that receives signals (e.g., at a high level or signals of 1) from the locking device management unit 210 (e.g., granting the right of user #1 to open/close a door) and a first opening/closing button 221*a*, a first NOT gate 225*a* that receives a signal (e.g., at a high level or a signal of 1) from the locking device management unit 210, and a first SR flip-flop 226*a* having a terminal S, through which an output signal (e.g., the at a high level or a signal of 1) of the first AND gate 224*a* is input, and a terminal R through which an output signal (e.g., at a low level or a signal of 1) of the first NOT gate 225*a* is input.

Further, the door locking device 220 may include a second AND gate 224*b* that receives signals (e.g., at a high level or signals of 1) from the locking device management unit 210 (e.g., granting the right of user #N to open/close a door) and a second opening/closing button 221*b*, a second NOT gate 225*b* that receives a signal (e.g., at a high level or a signal of 1) from the locking device management unit 210, and a second SR flip-flop 226*b* having a terminal S, through which an output signal (e.g., at a high level or a signal of 1) of the second AND gate 224*b* is input, and a terminal R through which an output signal (e.g., at a high level or a signal of 1) of the second NOT gate 125*b* is input.

According to the purpose of use, the door locking device 220 may receive the information on the granted right to open/close the door from the locking device management unit 210 and store the information. In this case, the AND gates 224*a* and 224*b* and the NOT gates 225*a* and 225*b* may receive the signal (e.g., at a high level or a signal of 1) granting the right of the user to open/close the door from the door locking device 220.

In addition, the door locking device 220 may further include an OR gate 228, and the OR gate 228 may receive a first output signal input through the terminal Q of the first SR flip-flop 226*a* and receive a second output signal input through the terminal Q of the second SR flip-flop 226*b*.

Here, an opening/closing driving unit 223 may be driven by receiving the output signal (e.g., at a high level or a signal of 1) of the OR gate 228. Further, a first opening/closing indicating lamp 222*a* may receive an output signal through the terminal Q of the first SR flip-flop 226*a*, and a second opening/closing indicating lamp 222*b* may receive an output signal through the terminal Q of the second SR flip-flop 226*b*.

Figure 3A:
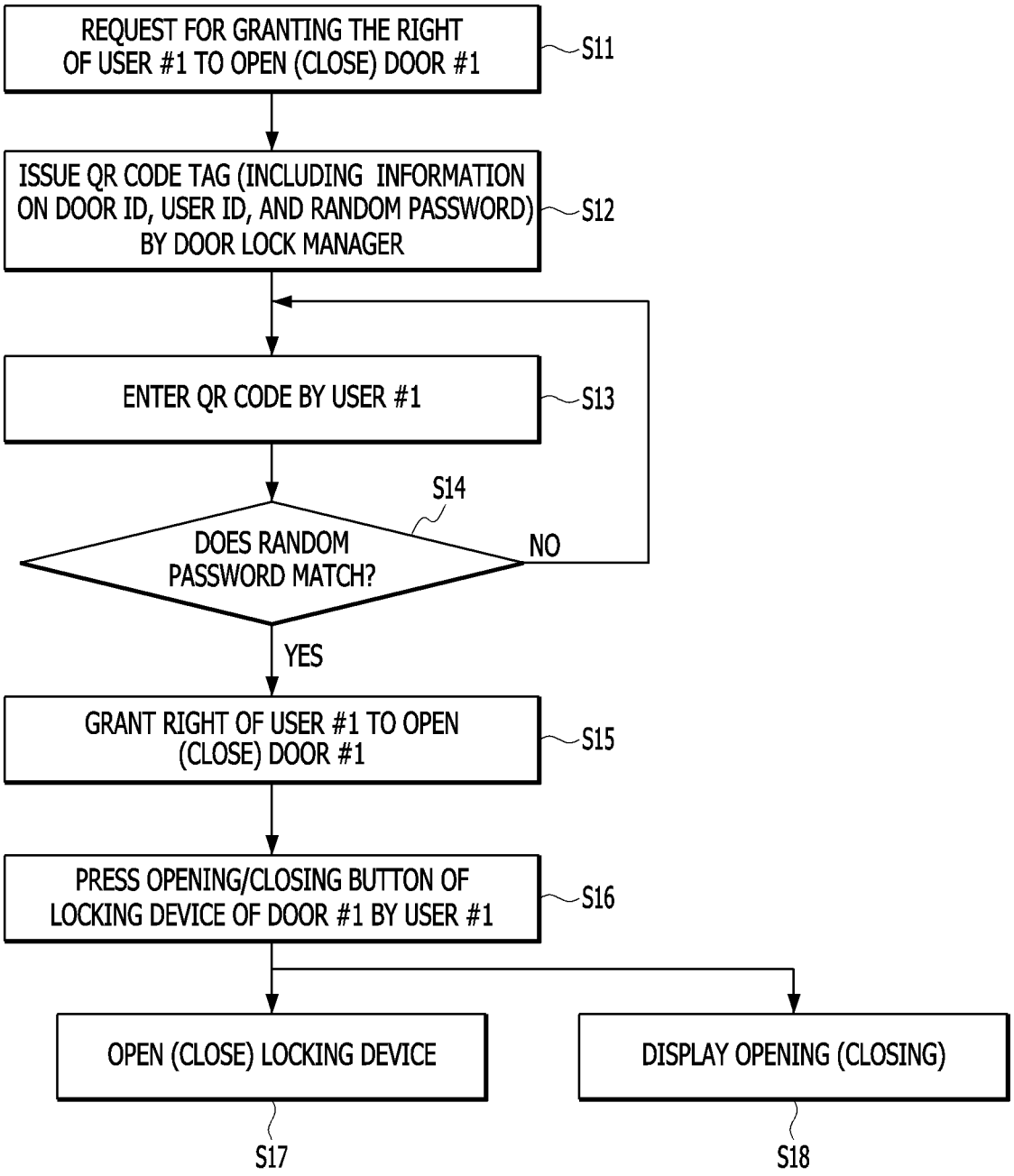
FIGS. 3A and 3B are flowcharts illustrating operation flows of a multi-locking device using a random password according to an embodiment of the present invention.

As illustrated in FIG. 3A, the opening/closing operation of the multi-locking device 200 using a random password according to the embodiment of the present invention may include an operation S11 of requesting the granting of the door opening/closing right, an operation S12 of issuing a QR code, an operation S13 of inputting the QR code, an operation S14 of determining whether there is a match, an operation S15 of granting the door opening/closing right, an operation S16 of pressing a button, and an operation S17 of closing a locking device and/or an operation S18 of displaying closing of the locking device.

In the operation S11 of requesting the granting of the door opening/closing right, for example, a user #1 requests the granting of the right to open/close a door #1 from a lock manager, that is, a locking device management unit 210.

In the operation S12 of issuing the QR code, for example, the locking device management unit 210 issues a QR code tag through a QR code outputting device 111. In this case, the QR code tag may include information of a door identification (ID), a user ID, and a random password. In addition, the QR code outputting device 111 may print and issue a QR code on paper or may wirelessly transmit the QR code to a mobile terminal of the user.

In the operation S13 of inputting the QR code, the user #1 enters a QR code of the user #1 through the QR code reader 130.

In the operation S14 of determining whether there is the match, the locking device management unit 210 compares and/or determines whether information on the QR code input in the above-described manner and the stored information on the granted right to open/close the corresponding door match each other. Here, when it is determined that the information on the QR code input in the above-described manner and the stored information on the granted right to open/close the corresponding door do not match each other, the operation S13 is performed, and when it is determined that the information on the QR code input in the above-described manner and the stored information on the granted right to open/close the corresponding door match each other, the operation S15 is performed.

In the operation S15 of granting the door opening/closing right, the locking device management unit 210 grants the right to open/close the door #1 to the user #1. In the case, a first opening/closing indicating lamp 222*a* for the user #1 may blink to display a close ready state.

Here, in the operation S14 of determining whether there is the match and the operation S15 of granting the door opening/closing right, according to the purpose of use, when the door locking device 220 has previously received the information on the granted right to open/close the door from the locking device management unit 210, the door locking device 220 may perform the matching determination and the granting the door opening/closing right.

In the operation S16 of pressing the button, an opening/closing button 121 provided in the door locking device 220 of the door #1 is pressed by the user #1.

In the operation S17 of closing the locking device and the operation S18 of displaying of the closing of the locking device, the door locking device 220 allows the door #1 to be opened (or closed) through an opening/closing driving unit 123 and may allow the open/closed state of the door to be displayed through the opening/closing indicating lamp 122. Even when one of N users closes the door #1, the door #1 is closed.

Figure 3B:
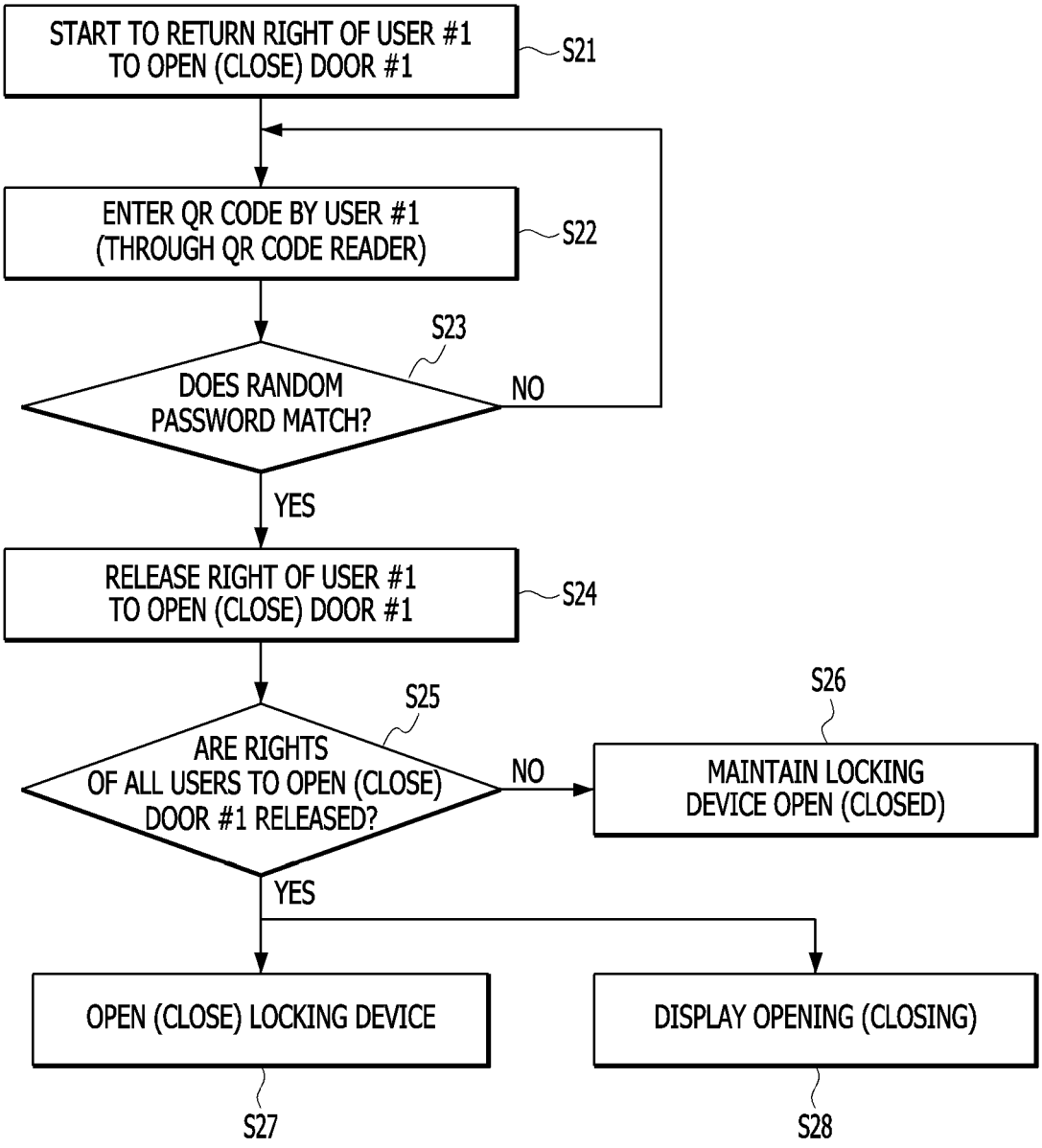

As illustrated in FIG. 3B, the closing/opening operation of the multi-locking device 200 using a random password according to the embodiment of the present invention may include an operation S21 of starting to return the door opening/closing right, an operation S22 of inputting a QR code, an operation S23 of determining whether there is a match, an operation S24 of releasing the door opening/closing right, an operation S25 of determining whether all the door opening/closing rights are released, an operation S26 of maintaining opening/closing, and an operation S27 of opening a locking device and/or an operation S28 of displaying opening of the locking device.

In the operation S21 of starting to return the door opening/closing right, the user #1 determines to return the right to open/close the door #1. Here, the "starting to return" means that the user intends to return the right to open/close the door after his or her work is finished. That is, the user determines to return the right to open/close the door (starts to return the door opening/closing right) and enters the QR code through the QR code reader. In this case, a device used initially when the user returns the right is also the QR code reader.

In the operation S22 of inputting the QR code, the user #1 enters a QR code of the user #1 through the QR code reader 130.

In the operation S23 of determining whether there is the match, the locking device management unit 210 compares and/or determines whether information on the QR code input in the above-described manner and the stored information on the granted right to open/close the door match each other.

Here, when it is determined that the information on the QR code input in the above-described manner and the stored information on the granted right to open/close the corresponding door do not match each other, the locking device management unit 210 proceeds to the operation S21, and when it is determined that the information on the QR code input in the above-described manner and the stored information on the granted right to open/close the corresponding door match each other, the locking device management unit 210 proceeds to the operation S23.

In the operation S24 of releasing the door opening/closing right, the locking device management unit 210 releases the right of the user #1 to open/close the door #1. In the case of a door locking device 220 having N opening/closing indicating lamps, the first opening/closing indicating lamp 222*a* for the user #1 may display an open/closed state. With the QR code used to grant and release the door opening/closing right once, the right to close the door cannot be granted again.

Here, in the operation S23 of determining whether there is the match and the operation S24 of releasing the door opening/closing right, according to the purpose of use, when the door locking device 220 has previously received the information on the granted right to open/close the door from the locking device management unit 210, the door locking device 220 may perform the matching determination and the releasing the door opening/closing right.

In the operation S25 of determining whether all the door opening/closing rights are released, the door locking device 220 determines whether the rights of all the users to open/close the door #1 are released. When it is determined that all the rights are not released, the operation S26 is performed, and when it is determined that all the rights are released, the operation S27 is performed.

In the operation S26 of maintaining opening/closing, the door locking device 220 continues to maintain the open/closed state as described above.

In the operation S27 of opening the locking device, the door locking device 220 opens the door #1 through the opening/closing driving unit 123.

[Modes of the Invention]

Hereinafter, exemplary embodiments of the present invention will be described in detail with reference to the accompanying drawings.

Embodiments of the present invention are provided to more completely describe the present invention to those skilled in the art, the following embodiments may be modified into various other forms, and the scope of the present invention is not limited to the embodiments. Rather, the embodiments are provided to thoroughly complete the present invention and fully convey the concept of the present invention to those skilled in the art.

Further, the thicknesses or sizes of layers illustrated in the following drawings are exaggerated for convenience and clarity of description. In the drawings, the same reference numerals denote the same elements. As used herein, the term "and/or" includes any and all combinations of one or more of the associated listed items. In addition, in this specification, it should be understood that when a member A is referred to as being "connected" to a member B, the member A may be directly connected to the member B or the member A may be indirectly connected to the member B with a member C interposed therebetween.

Terms used in this specification are considered in a descriptive sense only and not for purposes of limitation. As used in this specification, the singular forms include the plural forms unless the context clearly indicates otherwise. Further, it will be understood that the terms "comprise or include" and/or "comprising or including" when used herein, specify the presence of some stated shapes, integers, steps, operations, members, elements, or combinations thereof but do not preclude the presence or addition of one or more other shapes, integers, steps, operations, members, elements, or combinations thereof.

It should be clear that, although the terms "first," "second," etc. may be used herein to describe various members, components, regions, layers, and/or portions, these members, components, regions, layers, and/or portions are not limited by these terms. These terms are used only to distinguish one member, component, region, layer, or portion from another member, component, region, layer, or portion. Therefore, a first member, component, region, layer, or portion to be described below may refer to a second member, component, region, layer or portion without departing from the spirit and scope of the present invention.

In addition, a controller and/or other related devices or components according to the present invention may be implemented using any suitable hardware, firmware (e.g., application-specific semiconductor), and software or using a suitable combination of software, firmware, and hardware. For example, various components such as the controller and/or other related devices or components according to the present invention may be formed on one integrated circuit chip or on separate integrated circuit chips. Further, various components such as the controller and the like may be implemented on a flexible printed circuit film and may be formed on the same substrate as a tape carrier package, a printed circuit board, or the controller. Further, various components such as the controller and the like may be processes or threads performed in one or more processors in one or more computing devices, and the components may execute computer program instructions and interact with other components to perform various functions to be described below. The computer program instructions may be stored in a memory being operated in a computing device using a standard memory device such as a random access memory. The computer program instructions may also be stored in other non-transitory computer readable media such as a compact disc read only memory (CD-ROM), a flash drive, and the like. Further, those skilled in the art should recognize that functions of various computing devices may be combined with each other or integrated into one computing device or that functions of a particular computing device may be distributed to one or more other computing devices without departing from the exemplary embodiments of the present invention.

For example, the controller according to the present invention may be operated in a typical commercial computer including a central processing unit, a mass storage device such as a hard disk or a solid state disk, a volatile memory device, an input device such as a keyboard or a mouse, and an output device such as a monitor or a printer.

As described above, there is a field in which, when a plurality of users share and use a plurality of doors and open or close the doors, it is necessary for the users to obtain use rights from a manager and allow only one use (one open or close) (and it is necessary for the user to receive another key (right) from the manager in order to open or close the door again). The states of the doors may be divided into two types of states as follows.

O Type A (Closed State at Normal Times)

(Example) The type A corresponds to a case in which there are multiple secure filing cabinets (one locking device for each filing cabinet) that are shared and used by a plurality of users to store their security documents. Assuming that there are N identical keys, N users, who receive the keys of secure filing cabinets from a manager, open the filing cabinets, and lock the filing cabinets when their work is finished. When all the N keys are returned, the corresponding filing cabinets are considered to be finally closed.

O Type B (Open State at Normal Times)

(Example) The type B corresponds to a case in which there are multiple secure filing cabinets (N locking devices for each filing cabinet) that are shared and used by a plurality of users to store common security documents. N users receive N keys of secure filing cabinets from a manager, put common secure documents in the filing cabinets, and lock the filing cabinets. In order to take out the stored documents, all N locking devices should be unlocked (consent of all the users who set the lock is required). When all the N keys are returned, the corresponding filing cabinets are considered to be finally opened.

In the present invention, for the types A and B, it is possible to reduce the inconvenience caused when a plurality of users, who intend to open or close the same door, need to receive locks/keys from a manager and then return the locks/keys after use, and it is possible to efficiently control and manage the sharing and use of a plurality of doors by a plurality of users. Configurations and operations of the present invention for these above purposes will be described below.

FIG. 1 is a conceptual diagram illustrating a configuration of a multi-locking device 100 using a random password according to an embodiment of the present invention.

As illustrated in FIG. 1, the multi-locking device 100 using a random password according to the embodiment of the present invention may include a locking device management unit 110, a door locking device 120, and a Quick Response (QR) code reader 130. The multi-locking device 100 using a random password according to the embodiment of the present invention may further include a QR code outputting device 111.

When a user requests the granting of the right to open/close a door, the locking device management unit 110 may convert information on the granted right to open/close the door into a QR code, output the QR code, provide the QR code to the user, and store the information. Here, the locking device management unit 110 may be managed by a lock manager. Further, the QR code may be printed on paper and delivered to the user or wirelessly transmitted to a mobile terminal of the user.

When the QR code is printed and output on the paper, the QR code outputting device 111 may output the QR code under the control of the locking device management unit 110.

The QR code, which is output on the paper or transmitted to the mobile terminal of the user, may include a door identification (ID), a user ID, and a random password.

Both of the locking device management unit 110 and the QR code outputting device 111 may be installed in a control room.

The door locking device 120 may receive the information on the granted right to open/close the corresponding door from the locking device management unit 110 through (wired or wireless) communication. Here, there may be one or more doors. In the drawing, to help with understanding of the present invention, door #1 to door #N (here, N is a natural number) are illustrated. Here, a plurality of doors may be installed in a door room.

The QR code reader 130 may receive the QR code from the user and provide the QR code to the locking device management unit 110 and may provide the QR code to the door locking device 120 according to the purpose of use. In this way, many door locking devices 120 that should be provided for each door may be configured as simply as possible. Here, it is possible to change the installation position of the QR code reader 130 according to the purpose of the lock. For example, the QR code reader 130 may be installed in the control room or the door room.

Meanwhile, the door locking device 120 may further include an opening/closing button 121, an opening/closing indicating lamp 122, and an opening/closing driving unit 123. The opening/closing button 121 may be manipulated by the user to open or close the door. For example, the opening/closing indicating lamp 122 may display green when the door is opened and may display red when the door is closed. The opening/closing driving unit 123 serves to substantially open or close the door. For example, the opening/closing driving unit 123 may operate a solenoid (or a motor) to cause a locking bar to move rearward so that the door is opened or may operate the solenoid (or the motor) to cause a locking bar to move forward so that the door is closed.

In this way, the locking device management unit 110 may grant the right to open/close the door that matches the information on the QR code input from the QR code reader 130 to the corresponding user, and when the user manipulates the opening/closing button 121, the door locking device 120 may drive the opening/closing driving unit 123 to allow the door to be opened or closed.

According to the purpose of use, the door locking device 120 may receive the information on the granted right to open/close the door from the locking device management unit 110 and store the information. In this case, the door locking device 120 may compare the received information with the information provided through the QR code reader, and when the received information and the information provided through the QR code reader match, the door locking device 120 itself may grant the right to open/close the door.

Further, in the embodiment of the present invention, N concurrent users (here, N is a natural number) may use the door. In this case, the door locking device 120 may include N opening/closing buttons 121, N opening/closing indicating lamps 122, and one opening/closing driving unit 123.

FIGS. 2A and 2B are logic diagrams illustrating configurations of multi-locking devices 100 and 200 using a random password according to embodiments of the present invention.

First, as illustrated in FIG. 2A, a door locking device 120 may include an AND gate 124, a NOT gate 125, and an SR flip-flop 126. The AND gate 124 may receive an electrical signal from each of a locking device management unit 110 and an opening/closing button 121. For example, the AND gate 124 may receive a signal (e.g., at a high level or a signal of 1) for the right of a user to open/close a door from the locking device management unit 110 through any one input terminal or may receive a door open/close signal (at a high level or a signal of 1) from the opening/closing button 121 through another input terminal.

The NOT gate 125 may receive the signal (e.g., at a high level or a signal of 1) for the right of the user to open/close the door from the locking device management unit 110 through an input terminal.

According to the purpose of use, the door locking device 120 may receive information on the granted right to open/close the door from the locking device management unit 110 and store the information. In this case, the AND gate 124 and the NOT gate 125 may receive the signal (e.g., at a high level or a signal of 1) for the right of the user to open/close the door from the door locking device 120.

The SR flip-flop 126 may receive, for example, a high level signal from the AND gate 124 through a terminal S thereof and may receive, for example, a low level (or 0) signal from the NOT gate 125 through a terminal R thereof.

Accordingly, the SR flip-flop 126 may output, for example, a high level signal to each of the opening/closing indicating lamp 122 and the opening/closing driving unit 123 through a terminal Q thereof.

Meanwhile, the multi-locking device 200 using a random password, in which when the number of concurrent users per door is limited to N and displayed on a door locking device 220, may be as illustrated in FIG. 2B.

The door locking device 220 may include a first AND gate 224*a* that receives signals (e.g., at a high level or signals of 1) from a locking device management unit 210 (e.g., granting the right of user #1 to open/close a door) and a first opening/closing button 221*a*, a first NOT gate 225*a* that receives a signal (e.g., at a high level or a signal of 1) from the locking device management unit 210, and a first SR flip-flop 226*a* having a terminal S, through which an output signal (e.g., the at a high level or a signal of 1) of the first AND gate 224*a* is input, and a terminal R through which an output signal (e.g., at a low level or a signal of 1) of the first NOT gate 225*a* is input.

Further, the door locking device 220 may include a second AND gate 224*b* that receives signals (e.g., at a high level or signals of 1) from the locking device management unit 210 (e.g., granting the right of user #N to open/close a door) and a second opening/closing button 221*b*, a second NOT gate 225*b* that receives a signal (e.g., at a high level or a signal of 1) from the locking device management unit 210, and a second SR flip-flop 226*b* having a terminal S, through which an output signal (e.g., at a high level or a signal of 1) of the second AND gate 224*b* is input, and a terminal R through which an output signal (e.g., at a high level or a signal of 1) of the second NOT gate 125*b* is input.

According to the purpose of use, the door locking device 220 may receive the information on the granted right to open/close the door from the locking device management unit 210 and store the information. In this case, the AND gates 224*a* and 224*b* and the NOT gates 225*a* and 225*b* may receive the signal (e.g., at a high level or a signal of 1) of the right of the user to open/close the door from the door locking device 220.

In addition, the door locking device 220 may further include an OR gate 228, and the OR gate 228 may receive a first output signal input through the terminal Q of the first SR flip-flop 226*a* and receive a second output signal input through the terminal Q of the second SR flip-flop 226*b*.

Here, an opening/closing driving unit 223 may be driven by receiving the output signal (e.g., at a high level or a signal of 1) of the OR gate 228. Further, a first opening/closing indicating lamp 222*a* may receive an output signal through the terminal Q of the first SR flip-flop 226*a*, and a second opening/closing indicating lamp 222*b* may receive an output signal through the terminal Q of the second SR flip-flop 226*b*.

FIGS. 3A and 3B are flowcharts illustrating operation flows of a multi-locking device 100 using a random password according to an embodiment of the present invention. Here, FIG. 3A illustrates an opening/closing operation of a door locking device 120 and FIG. 3B illustrates a closing/opening operation of the door locking device 120.

As illustrated in FIG. 3A, the opening/closing operation of the multi-locking device 100 using a random password according to the embodiment of the present invention may include an operation S11 of requesting the granting of the door opening/closing right, an operation S12 of issuing a QR code, an operation S13 of inputting the QR code, an operation S14 of determining whether there is a match, an operation S15 of granting the door opening/closing right, an operation S16 of pressing a button, and an operation S17 of opening/closing a locking device and/or an operation S18 of displaying opening/closing of the locking device.

In the operation S11 of requesting the granting of the door opening/closing right, for example, a user #1 requests the granting of the right to open/close a door #1 from a lock manager, that is, a locking device management unit 110.

In the operation S12 of issuing the QR code, for example, the locking device management unit 110 issues a QR code tag through a QR code outputting device 111. In this case, the QR code tag may include information of a door ID, a user ID, and a random password. In addition, the QR code outputting device 111 may print and issue a QR code on paper or may wirelessly transmit the QR code to a mobile terminal of the user.

In the operation S13 of inputting the QR code, the user #1 enters a QR code of the user #1 through the QR code reader 130.

In the operation S14 of determining whether there is the match, the locking device management unit 110 compares and/or determines whether information on the QR code input in the above-described manner and the stored information on the granted right to open/close the corresponding door match each other. Here, when it is determined that the information on the QR code input in the above-described manner and the stored information on the granted right to open/close the corresponding door do not match each other, the operation S13 is performed, and when it is determined that the information on the QR code input in the above-described manner and the stored information on the granted right to open/close the corresponding door match each other, the operation S15 is performed.

In the operation S15 of granting the door opening/closing right, the locking device management unit 110 grants the right to open/close the door #1 to the user #1. In the case of a door locking device 220 having N opening/closing indicating lamps, a first opening/closing indicating lamp 222*a* for the user #1 may blink to display an open/close ready state.

Here, in the operation S14 of determining whether there is the match and the operation S15 of granting the door opening/closing right, according to the purpose of use, when the door locking device 120 has previously received the information on the granted right to open/close the door from the locking device management unit 110, the door locking device 120 may perform the matching determination and the granting the door opening/closing right.

In the operation S16 of pressing the button, the opening/closing button 121 provided in the door locking device 120 of the door #1 is pressed by the user #1. In the case of the door locking device 220 having N opening/closing buttons, a first opening/closing button 221*a* of the door #1 may be pressed by the user #1.

In the operation S17 of opening/closing the locking device and the operation S18 of displaying of the opening/closing of the locking device, the door locking device 120 allows the door #1 to be opened (or closed) through an opening/closing driving unit 123 and may allow the open/closed state of the door to be displayed through the opening/closing indicating lamp 122. In the case of the door locking device 220 having N opening/closing indicating lamps, the first opening/closing indicating lamp 222*a* may display the open/closed state of the door #1 of the user #1.

As illustrated in FIG. 3B, the closing/opening operation of the multi-locking device 100 using a random password according to the embodiment of the present invention may include an operation S21 of starting to return the door opening/closing right, an operation S22 of inputting a QR code, an operation S23 of determining whether there is a match, an operation S24 of releasing the door opening/closing right, an operation S25 of determining whether all the door opening/closing rights are released, an operation S26 of maintaining opening/closing, and an operation S27 of closing/opening a locking device and/or an operation S28 of displaying closing/opening of the locking device.

In the operation S21 of starting to return the door opening/closing right, the user #1 determines to return the right to open/close the door #1. Here, the "starting to return" means that the user intends to return the right to open/close the door after his or her work is finished. That is, the user determines to return the right to open/close the door (starts to return the door opening/closing right) and enters the QR code through the QR code reader. In this case, a device used initially when the user returns the door opening/closing right is also the QR code reader.

In the operation S22 of inputting the QR code, the user #1 enters a QR code of the user #1 through the QR code reader 130.

In the operation S23 of determining whether there is the match, the locking device management unit 110 compares and/or determines whether information on the QR code input in the above-described manner and the stored information on the granted right to open/close the door match each other.

Here, when it is determined that the information on the QR code input in the above-described manner and the stored information on the granted right to open/close the corresponding door do not match each other, the locking device management unit 110 proceeds to the operation S21, and when it is determined that the information on the QR code input in the above-described manner and the stored information on the granted right to open/close the corresponding door match each other, the locking device management unit 110 proceeds to the operation S23.

In the operation S24 of releasing the door opening/closing right, the locking device management unit 110 releases the right of the user #1 to open/close the door #1. In the case of a door locking device 220 having N opening/closing indicating lamps, the first opening/closing indicating lamp 222*a* for the user #1 may display an open/closed state. With the QR code used to grant and release the door opening/closing right once, the right to close the door cannot be granted again.

Here, in the operation S23 of determining whether there is the match and the operation S24 of releasing the door opening/closing right, according to the purpose of use, when the door locking device 120 has previously received the information on the granted right to open/close the door from the locking device management unit 110, the door locking device 120 may perform the matching determination and the releasing the door opening/closing right.

In the operation S25 of determining whether all the door opening/closing rights are released, the door locking device 120 determines whether the rights of all the users to open/close the door #1 are released. When it is determined that all the rights are not released, the operation S26 is performed, and when it is determined that all the rights are released, the operation S27 is performed.

In the operation S26 of maintaining opening/closing, the door locking device 120 continues to maintain the open/closed state as described above.

In the operation S27 of closing/opening the locking device and the operation S28 of displaying of the closing/opening of the locking device, the door locking device 120 opens or closes the door #1 through the opening/closing driving unit 123 and displays the open/closed state of the door through the opening/closing indicating lamp 122.

FIGS. 4A and 4B are exemplary diagrams illustrating a locking management system screen/communication package and a communication data package in the multi-locking device 100 using a random password according to the embodiment of the present invention.

As illustrated in FIG. 4A, a locking management system screen displays a number, a door ID, a user having the right to open/close a door, and a random password. However, the random password is stored only for each user and is not displayed. Further, as illustrated in FIG. 4B, a communication data package may include a door ID, a user ID, a random password, and a bit for granting the right to open/close a door.

In this way, in the multi-locking device 100 using a random password according to the embodiment of the present invention, it is possible to reduce the inconvenience caused when a plurality of users, who intend to open or close the same door, need to receive locks/keys from a manager and then return the locks/keys after use. Further, in the multi-locking device 100 using a random password according to the embodiment of the present invention, it is possible to efficiently control and manage the sharing and use of a plurality of doors by a plurality of users.

The above description is only embodiments for implementing the multi-locking device using a random password according to the present invention. The present invention is not limited to the above embodiments and, and as claimed in the claims below, various modifications may be made without departing from the spirit and scope of the present invention by those skilled in the art to which the present invention pertains.

INDUSTRIAL APPLICABILITY

The present invention can be used in a field in which, when a plurality of users share and use a plurality of doors and open or close the doors, it is necessary for the user to obtain use rights (key) from a manager and it is necessary for the user to be controlled and managed so that the user may use the door with the obtained use rights only one time (open-closed: one time) or for a specified number of times.

REFERENCE NUMERALS

100: MULTI-LOCKING DEVICE USING RANDOM PASSWORD
110: LOCKING DEVICE MANAGEMENT UNIT
111: QR CODE OUTPUTTING DEVICE
120: DOOR LOCKING DEVICE
121: OPENING/CLOSING BUTTON
122: OPENING/CLOSING INDICATING LAMP
123: OPENING/CLOSING DRIVING UNIT
124: AND GATE
125: NOT GATE
126: SR FLIP-FLOP
130: QR CODE READER

The invention claimed is:

1. A multi-locking device comprising:

a locking device management unit configured to, when a user requests granting of the right to open/close a door, convert information on the granted right to open/close the door into a Quick Response (QR) code, output the QR code, provide the QR code to the user, and store the information;

a door locking device configured to receive the information on the granted right to open/close the door from the locking device management unit; and a QR code reader configured to receive the QR code from the user and provide the QR code to the locking device management unit, wherein the door locking device further includes an opening/closing button and an opening/closing driving unit, and when information on the provided QR code matches the information on the granted right to open/close the door stored in the locking device management unit so that the door locking device receives the right to open/close the door from the locking device management unit, and when the opening/closing button is manipulated, the opening/closing driving unit is driven to open/close the door, wherein:

N concurrent users (here, N is a natural number) use the door; and the door locking device includes N opening/closing buttons and one opening/closing driving unit.

2. The multi-locking device of claim 1, wherein:

the locking device management unit further includes a QR code outputting device; and a QR code output from the QR code outputting device includes a door identification (ID), a user ID, and a random password.

3. The multi-locking device of claim 1, wherein the door locking device includes:

an AND gate configured to receive signals from the locking device management unit and the opening/closing button;

a NOT gate configured to receive a signal from the locking device management unit; and an SR flip-flop having a terminal S, through which an output signal of the AND gate is input, and a terminal R through which an output signal of the NOT gate is input, wherein an output signal is input to the opening/closing driving unit and an opening/closing indicating lamp through a terminal Q of the SR flip-flop.

4. The multi-locking device of claim 1, wherein the door locking device is configured to:

receive the information on the granted right to open/close the door from the locking device management unit and store the information;

compare the received information with the information provided through the QR code reader; and when the received information matches the information provided through the QR code reader, grant the right to open/close the door by itself.

5. The multi-locking device of claim 1, wherein the door locking device includes:

a first AND gate configured to receive signals from the locking device management unit and a first opening/closing button;

a first NOT gate configured to receive a signal from the locking device management unit;

a first SR flip-flop having a terminal S, through which an output signal of the first AND gate is input, and a terminal R through which an output signal of the first NOT gate is input;

a second AND gate configured to receive signals from the locking device management unit and a second opening/closing button;

a second NOT gate configured to receive a signal from the locking device management unit;

a second SR flip-flop having a terminal S, through which an output signal of the second AND gate is input, and a terminal R through which an output signal of the second NOT gate is input;

an OR gate configured to receive a first output signal through a terminal Q of the first SR flip-flop and receive a second output signal through a terminal Q of the second SR flip-flop;

the opening/closing driving unit configured to receive an output signal of the OR gate;

a first opening/closing indicating lamp configured to receive an output signal through the terminal Q of the first SR flip-flop; and a second opening/closing indicating lamp configured to receive an output signal through the terminal Q of the second SR flip-flop.

* * * * *